United States Patent [19]

Sunol et al.

[11] Patent Number: 5,041,192

[45] Date of Patent: Aug. 20, 1991

[54] SUPERCRITICAL DELIGNIFICATION OF WOOD

[75] Inventors: Aydin K. Sunol, Port Richey, Fla.; Shan L. Chen, Secane, Pa.

[73] Assignee: University of South Florida, Tampa, Fla.

[21] Appl. No.: 245,844

[22] Filed: Sep. 16, 1988

[51] Int. Cl.[5] ..... D21C 3/02

[52] U.S. Cl. ..... 162/63; 162/72; 162/77; 162/81; 162/82; 162/83; 162/90; 162/64

[58] Field of Search ..... 162/70, 72, 82, 90, 162/63, 77, 81, 83, 64

[56] References Cited

U.S. PATENT DOCUMENTS

| | | | |
|---|---|---|---|
| 3,661,698 | 5/1972 | Clayton et al. | 162/82 |
| 3,707,436 | 12/1972 | O'Connor | 162/63 |
| 4,308,200 | 12/1981 | Fremont | 530/202 |
| 4,397,712 | 8/1983 | Gordy | 162/63 |
| 4,644,060 | 2/1987 | Chou | 162/72 |
| 4,714,591 | 12/1987 | Avedesian | 162/16 |

OTHER PUBLICATIONS

Li et al., "Interaction of Supercritical Fluids with Lignocellulosic Materials", Ind. Eng. Chem. Res., vol. 27, No. 7, Jul. 1988, pp. 1301-1312.

CA 91:1422SH, vol. 91, No. 20, 1979.

Paper Chem No. 58-09926, "Supercritical Pulping A New Concept", Nov. 1987.

*Primary Examiner*—Karen M. Hastings

*Attorney, Agent, or Firm*—Ronald E. Smith; Joseph C. Mason, Jr.

[57] ABSTRACT

An improved wood pulping process for the delignification of wood in a solvent wherein the solvent is a supercritical fluid under supercritical conditons and contains a delignification agent such as sodium hydroxide, sodium sulfide and/or sodium bisulfate.

14 Claims, 1 Drawing Sheet

SUPERCRITICAL DELIGNIFICATION OF WOOD

TECHNICAL FIELD

The present invention relates to an improved method for increasing the yield and quality of pulp wherein delignification of a lignocellulose material is accomplished with a fluid under supercritical conditions.

BACKGROUND ART

From a chemical point of view, woods are constituted of four major components: cellulose, hemicellulose, lignin and extractives. In order to make cellulosic pulp from wood products, the wood fibers, and particularly their main constituent cellulose, must be liberated from the other components. It is in the digestor section of pulping processes that fiber liberation by delignification is achieved. However, it is also important that the delignification be conducted under conditions which do not deleteriously affect fiber quality. It is the objective of wood pulping, or digestion, to separate the cellulose fibers one from another in a manner that preserves the inherent fiber strength and to remove as much of the lignin, extractives and hemicellulose materials as is required by end-use considerations. While a number of pulping processes are known, three principal chemical pulping processes are the soda, the kraft, and the sulfite processes.

The soda process uses sodium hydroxide as the cooking chemical for delignification purposes, and has been largely superseded by the kraft process.

Kraft processes are applicable to nearly all species of wood and are characterized by their use of sodium hydroxide and sodium sulfide as the active delignification agents in the digestor. During this treatment, lignin is extensively degraded and the degradation products are dissolved. Carbohydrates, in particular hemicelluloses, undergo partial degradation and dissolution. Extractives are, to a large extent, removed.

In contrast to the kraft processes, sulfite pulping processes are sometimes used. The sulfite processes utilize calcium, sodium, magnesium, or ammonium bisulfite in combination with free or excess sulfur dioxide as the cooking chemicals in the digestor. Bisulfite processes use sodium, magnesium, or ammonium bisulfite in the digestor.

Without doubt, the various kraft processes are most frequently used for papermaking today.

However, the kraft process involves relatively complicated capital and energy intensive recovery cycles for recycling the cooking chemicals back to the digestor section. Thus, notwithstanding the virtually universal acceptance of kraft or alkaline processes for pulping wood and papermaking processes, current kraft pulping processes are characterized by prolonged impregnation and digestion times due to mass and heat transfer limitations, complicated recovery cycles, and non-uniform pulp quality. Furthermore, delignification is relatively incomplete in the digestor and post digestor delignification is frequently necessary.

The pulping processes which yield flexible fibers without undue carbohydrate damage produce papers of the highest strength. Flexible fibers produce paper with a relatively large area of fiber-to-fiber contact, resulting in sheets of higher strength. The amount of lignin left in the pulp has a bearing on the tear, burst, and fold properties of paper. Because these properties increase with decreasing lignin content it is desirable to remove as much lignin as reasonable costs permit. It is, therefore, clear that there exists a great need in the art for improved efficiency in the digestion of wood so as not only to maintain or improve delignification, but also to reduce the cost of further pulp processing.

DISCLOSURE OF INVENTION

The deficiencies in prior art pulping processes have now been largely overcome in this invention by the use of supercritical fluids as part of the pulping process.

Accordingly, among the objects of this invention is to provide a modified pulping or kraft process wherein superior yields of pulp are obtained as compared to conventional pulping processes through the selective use of supercritical fluids; to provide a process with higher pulp yields for a given delignification level; to provide a process for the fast and selective removal of lignin from wood whereby the digestion times and temperatures normally associated with conventional processes are reduced; to provide a process wherein lignin repolymerization and precipitation on the pulp is minimized; and to provide a process wherein pulp quality and the efficiency of delignification can be optimized and controlled with minimum chemical consumption.

A further object includes providing a process for the preparation of pulp with enhanced quality, particularly pulp uniformity, resulting in reducing the number of post-treatment steps needed to provide high quality pulp.

Another object is to provide an alkaline pulping process for producing pulp from different wood species and types which is relatively pollution free.

More particularly, it is an object of this invention to provide a process for the delignification of wood in which a lignocellulosic material is delignified with an active delignification agent comprising an aqueous solution of sodium hydroxide, preferably containing sodium sulfide, in an ammonia based solvent comprising ammonia containing up to about 12% water under supercritical conditions.

These and other objects of the invention may be achieved by the various embodiments of the invention.

One embodiment of the invention is a process for converting wood to pulp which comprises contacting wood with a fluid medium containing a reactive chemical agent under supercritical conditions sufficient to remove lignin, extractives, and hemicellulose for the wood thereby making a full chemical pulp.

Another embodiment of the invention is a process for removing lignin from a lignin containing cellulosic material which comprises contacting the cellulosic material with a fluid medium containing an active delignification agent under supercritical conditions whereby lignin is removed from the cellulosic material.

A further embodiment is a process for the delignification of a cellulosic material containing lignin which comprises impregnating the cellulosic material with a delignification agent and digesting the impregnated material in an ammonia based fluid comprising ammonia containing less than about 12% by weight water under supercritical conditions.

A still further embodiment is a process for making paper which comprises impregnating wood with a first fluid containing an alkaline medium or acid medium under supercritical conditions, digesting the impregnated wood in the presence of a second fluid maintained under supercritical conditions sufficient to extract lignins, extractives and hemicellulose from the wood and to separate the wood into essentially discrete fibers thereby producing a full chemical pulp, separating a liquor comprising second fluid containing lignins, extractives and hemicellulose from the pulp and treating the pulp to conditions sufficient to convert the pulp to paper.

The improved extraction or delignification process of this invention can be generally carried out by means known to the art in a manner similar to a conventional kraft process but using less equipment. For example, the extraction operation can be conducted in a digestor, as a batch, or semi-batch operation. The digestor is provided with suitable heating means and is designed to withstand the pressures utilized. Further, because of the fast removal of lignin from hemicellulose materials which can be realized by the process of this invention, lignin can be removed by conducting the instant process as a continuous extraction or semi-continuous process, which can be operated in a co-current or counter-current mode, again using vessels designed to operate under the temperature and pressure conditions required for the process. After the extraction step, temperature and pressure conditions are changed so as to allow the supercritical fluid to become non-supercritical which allows the extracted lignin to precipitate and the sensitivity of solubilities in the supercritical fluid to temperature, pressure, and concentration allows efficient stagewise recovery of the components.

The invention accordingly comprises the features of construction, combination of elements and arrangement of parts that will be exemplified in the descriptions set forth hereinafter and the scope of the invention will be set forth in the claims.

BRIEF DESCRIPTION OF DRAWINGS

For a fuller understanding of the nature and objects of the invention, reference is made to the following detailed description, taken in connection with the accompanying drawings in which.

BEST MODES FOR CARRYING OUT THE INVENTION

Figure 1:
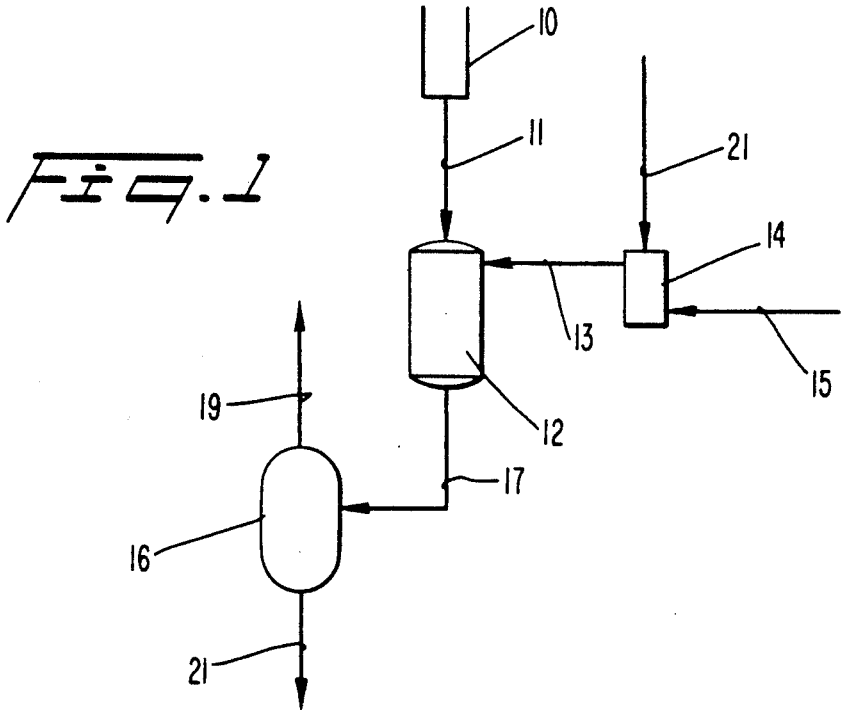
FIG. 1 is a schematic representation of a prototype supercritical delignification system of this invention.

The present invention relates to a unique method for delignification/digestion of a lignocellulose material, typically wood, which can be, for example in the form of oven dry, or as received, or pretreated wood, or saw dust, or wood chips for the purpose of obtaining high quality pulp.

By using reactive supercritical fluid mixtures, almost complete delignification of wood, high yields, and high quality pulp can be obtained within minutes, typically within ten minutes.

Although other supercritical fluids may be used in the practice of this invention, such as those compounds with critical temperatures in the range of 5° C. to 250° C. including those selected from the group consisting of lower alkenes, lower alkanes, nitrous oxide, sulfur dioxide, ammonia, water, lower straight chain alcohols, amines, phenol, carbon dioxide, and mixtures thereof, the preferred fluid to be utilized as a supercritical fluid in the process of this invention is an ammonia based solvent, that is, ammonia containing up to about 12% water, preferably about 4–8% water. Amines could also be used effectively. It is technically more advantageous with amines. However, amines are more expensive. One advantage with amines is in more selective removal of lignin. Because the digestion chemicals are soluble in the solvent used in the instant process the solvent can also be used as a means of transporting those chemicals into and out of the lignocellulose matrix, as described herein.

While the present invention will be described in terms of a method for supercritical delignification of wood in the digestor section of, for example, a pulp and paper process, it is to be understood that the supercritical extraction process of this invention can also be utilized in other processes, for example black liquor recovery, the extraction of waxes and resins, biomass conversion, wood drying for specialty applications, and in-situ modification of wood chips.

Due to the properties of supercritical fluids such as solubility enhancement and high mobility, the supercritical extraction process of this invention offers the opportunity to overcome or at least minimize some of the shortcomings of the present commercial alkaline pulping processes. For example, because the supercritical fluids of the process of this invention can dissolve solid material of low volatility, those fluids can carry fragmented lignin out of the fibers during the process and thereby avoid repolymerizing and precipitation of lignin on the fibers. In addition, because of the ability of the solvent to carry reaction chemicals into the lignocellulose matrix, pulp quality can be optimized and the efficiency of delignification controlled so as to minimize the consumption of chemicals.

In the process of this invention the selected pulp source is impregnated with an active delignification agent in an alkaline, neutral, or acidic environment, preferably, alkaline environment, which is comprised of one or more cooking chemicals comprising an aqueous solution of sodium hydroxide, and/or sodium sulfide, or mixtures thereof, wherein the sulfidity of the solution is from about 0% to about 100%. Other chemicals, such as sodium bisulfate, may also be utilized as the delignification agent. The sodium based cooking chemicals may be replaced by ammonium or potassium based chemicals. The impregnation of reactive chemicals and the extraction of the lignocellulosic material is carried out under supercritical conditions using the supercritical fluids of this invention.

The delignification agent can be carried into the digestor/extraction vessel by the supercritical fluid, allowing for improved control of the digestion process. Thus, in such an operation, digestion to separate delignification of the cellulosic material is carried out at a controlled rate and liberated lignin and chemicals and supercritical fluid are removed as they are separated from the cellulosic material. In this approach, the delignification agent is first dissolved in the supercritical fluid at a concentration of up to about 15% by weight or more, the resulting mixture is brought to supercritical conditions, and the now supercritical fluid mixture containing the delignifying agent is introduced into the digestor.

It is preferred that the equipment utilized for the practice of this invention be designed to allow operation in a semi-batch mode. In such a mode the cellulosic source is added to and remains in the digestions/extraction vessel while the supercritical fluid solvent, which contains the delignifying agent as discussed above, in continuously circulated into the vessel, through said cellulosic source, and out of said vessel. As the solvent leaves the vessel it contains dissolved lignin, hemicellulose, extractives, resins, and some cellulosic material. The extraction residue dissolves in the water present as fibrous or full chemical pulp. After digestion of the wood is completed the full chemical pulp is processed by means known to the art to provide the desired product, usually paper or other biomass.

In the practice of the process of this invention the temperature selected is at least the critical temperature for the solvent selected, and preferably, slightly above the critical temperature. While the temperatures which can be used can be as high as those generally found in a digestor of a conventional alkaline process, (about 170° C.), one of the advantages of the process is that it provides for operation of a digestor at lower, and therefore less severe temperatures without sacrificing yield or quality. On the other hand a minimum temperature of about the critical temperature of the selected supercritical fluid must be maintained. If the instant process using aqueous ammonia as the supercritical process is operated at a temperature of about 175° C., up to about 12% water can be present in the ammonia. However, it is preferred to operate at temperatures below about 170° C., and therefore a water content of about 10% maximum. The preferred temperature will be in the range of about 145° C. to about 160° C., allowing for from about 4–8% water in the ammonia. Preferably the digestion temperature will be slightly above the critical temperature of the solvent up to about 1.5 times the critical temperature. The selection of a specific temperature or range of temperature depends, of course, upon the critical temperature and critical pressure of the supercritical fluid to be used.

For the operating temperatures contemplated, the pressures required to maintain, say, ammonia as a supercritical fluid will be at least 163.9 pounds per square inch absolute (p.s.i.a.) (the critical pressure of ammonia), up to about 2205 p.s.i.a. (i.e., the critical pressure for an ammonia-water mixture of about 12% water). Temperature, solvent composition, and pressure range during extraction can be selected so as to maximize pulp quality and yield as well as to decrease processing time as is evident from the teachings herein.

It is also contemplated that the supercritical solvent disclosed and claimed in the method of this invention may be enhanced by the addition of entrainers thereto. Thus, in addition to, say, ammonia as the solvent, it is contemplated that carbon dioxide, propane and ethane can be utilized in conjunction therewith to lower the critical temperature. That is, carbon dioxide, propane and ethane can be used to "construct" a tailor made solvent. Such "construction" might be desirable in order to obtain a proper extraction temperature, it has been observed that supercritical extraction is best conducted at a temperature at least as great as the critical temperature of the primary solvent but no more than about 1.5 times the critical temperature.

With reference to FIG. 1 which is a schematic drawing for one embodiment of the invention, wood, which may be in the form of wood chips as contained in storage hopper 10 from which chips are withdrawn through line 11 into impregnator/digestor 12. Vessel 12 may be operated in batchmode, semi-batch mode or continuous mode by means known to the art. The wood chips in hopper 10 typically, have been pre-conditioned by debarking, chipping, screening and denaturing by well known means not shown. Chip lengths are about ½" to 1". Practice of this invention routinely permits the use of chips having significantly longer lengths, e.g., 4" to 6". The chemical composition and moisture content of the chips can vary considerably depending on whether the chips are from softwoods, hardwoods, or mixtures of softwood and hardwood. A typical softwood chip from loblolly pine may have the following composition on a wood-oven dry weight basis:

| | |
|---|---|
| Moisture content | 10.01% |
| Extractives | 3.67% |
| Lignin | 28.13% |
| Carbohydrates | 68.20% |

White liquor carried by supercritical fluid is introduced into digestor 12 through line 13. The supercritical fluid mixture in line 13 may comprise sodium hydroxide, sodium sulfide, water, and ammonia as the supercritical fluid carrier or solvent. This supercritical fluid mixture may be prepared by stripping the white liquor mixture entering vessel 14 via line 21 with ammonia entering vessel 14 via line 15. Vessels 14 and 12 are maintained under supercritical conditions. These conditions include a temperature from 5° C. to 250° C. and a pressure from 400 to 3500 pounds per square inch absolute (p.s.i.a.) preferably, from 1800 to 3000 pounds per square inch absolute. For the ammonia supercritical fluid operation, these conditions may include a temperature of about 150° C. and a pressure of about 2100 p.s.i.a. Typical white liquor may have a sulfidity from 5% to 80% by weight using a sodium hydroxide—sodium sulfide mixture. Preferably, the white liquor, as aforesaid, will have a sulfidity from 40% to 75% by weight.

Impregnation of the white liquor, which is a reactive chemical, into the matrix of the wood occurs in an impregnation zone of vessel 12 using the supercritical fluid as the carrier. The impregnation zone may be a separate vessel, not shown, or may be the upper portion of the digestor 12. Alternatively, and preferably, for the practice of this invention, impregnation of the white liquor and digestion or cooking of the chips occurs concurrently. Contact or dwell times within vessel 12 may be from one minute to thirty minutes for both impregnation and digestion. Using ammonia as the supercritical fluid and kraft white liquor the contact or dwell time is typically about ten minutes to achieve almost complete delignification of the chips.

The cooked chips and liquor are withdrawn from vessel 12 via line 17 and introduced into blow tank 16. The pressure in tank 16 is essentially atmospheric but may be superatmospheric sufficient to separate the supercritical fluid plus selected residual unreacted white liquor components for recirculation to vessel 14 and/or vessel 12 by means not shown. Flash steam, noncondensable gases generated during the cook, volatile material may also be part of the recirculation by means not shown. The fibrous material remaining in the blow tank 16 after removal of the black liquor containing extractives, liquor, and other wood components by means known to the art, not shown, is the pulp which is withdrawn through line 21 for processing into paper by means now shown but which are known to those skilled in the art.

In the practice of this invention, the kappa number of the pulp is equivalent to the kappa number of a conventional kraft processing. The kappa number is a measure of oxidizable wood substance left in the pulp after all water soluble material has been washed from it and, for any given wood sample, is directly related to lignin content.

As previously noted, the preferred supercritical fluid for the practice of this invention is an ammonia based solvent containing ammonia having from 0% to 15% by weight water maintained in a supercritical state. Following digestion of loblolly pine chips in vessel 12 with standard kraft white liquor with supercritical ammonia, the pulp obtained had a kappa number of 2.64 after two hours of contact time; 3.66 after 40 minutes; and 14.3 after ten minutes. Pulp yields of 40% to 60% are typical and pulp yields of 40% to 50% are routinely achieved in the practice of this invention.

With the loblolly pine chips previously described the liquor content of the chips was dropped from 28.13% to about 1% by the practice of this invention. This represents essentially complete removal of lignin from the fibers of the wood.

A well accepted relationship between yield and kappa number has been confirmed in a series of papers published in the period 1969–73. See Keays, J. L. et al., TAPPI, 52(5), 904 (1969); Hatton, J. V. et al., Pulp Paper Mag. Can., 71(11/12), T259 (1970), 73(4), T103 (1972), and data on loblolly pine from a kraft process. Kleppe, P. J. et al., Forest Prod. J., 20(5), 50 (1970). That relationship is expressed as follows:

| |
|---|
| Total Pulp Yield (% on oven dry wood) = |
| +40.65 + 0.14 (kappa number) --- kappa up to 90 |
| +37.15 + 0.18 (kappa number) --- kappa 90–140 |

Figure 2:
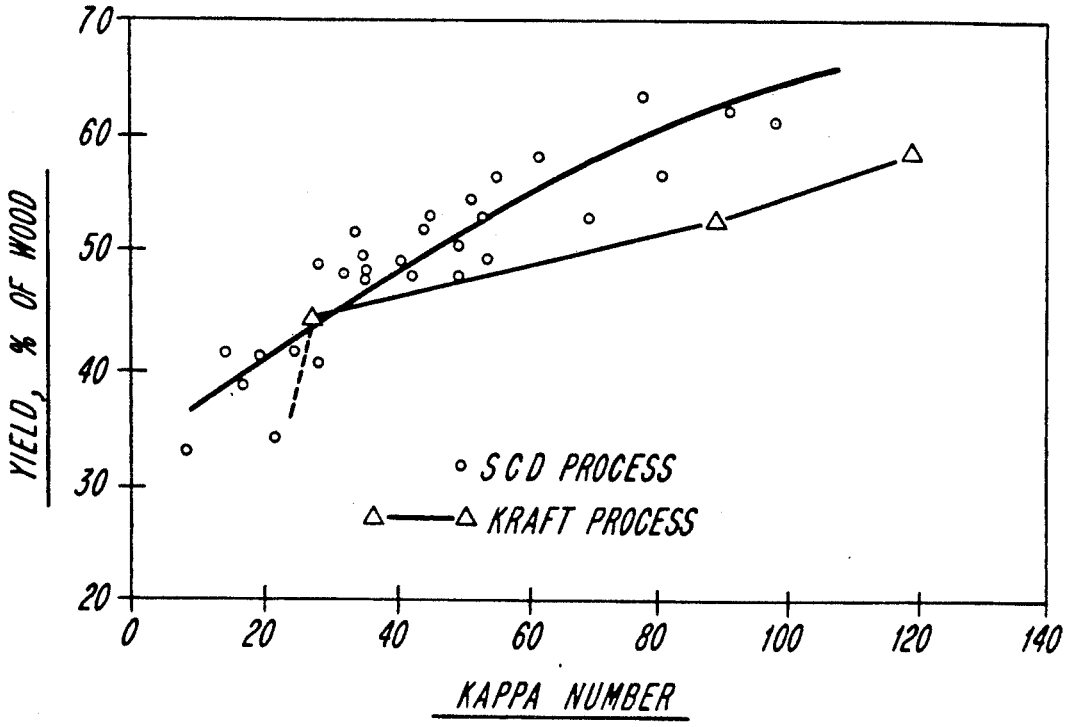
FIG. 2 is a plot of yield versus kappa number for pulp obtained from the supercritical process which is the subject of the invention, and for pulp obtained from a conventional kraft process.

Using the yield and kappa number data for the supercritical delignification process of this invention and for a conventional kraft process as obtained by Kleppe (all data from loblolly pine), and the equations set forth above, the relationship of yield to lignin content, (expressed as kappa number) was plotted for each process and is shown in FIG. 2.

From FIG. 2 the obvious superiority of the inventive process to the kraft process at both high and low yields is evident. At kappa number 30, which is a common target for bleachable grades of kraft pulp, the difference between the time of 10 minutes is considerably less than for a kraft process and is accomplished at an average temperature of 154° C., well below a typical kraft process.

To further demonstrate the superiority of the supercritical delignification process of this invention the properties of paper made from pulp produced by the inventive process were determined. For this purpose, two experiments were performed in which pulp was prepared by the supercritical delignification process and the resulting pulp used to prepare paper in the conventional manner. In the preparation of the pulp the temperature of digestion was 151° C., pressure was 2058 p.s.i.a., the water content of the supercritical ammonia solvent was 4% and the delignification reaction was carried out for 5 minutes. In both cases the sulfidity of the white liquor was 16%. Analysis of the paper from the experiments, measured by the standard TAPPI unbeaten handsheet analysis procedure, gave the following results:

| | Experiment # | |
|---|---|---|
| | I | II |
| Viscosity, cp | 4.16 | 3.19 |
| Frazier porosity, cfm | 19.20 | 28.60 |
| Mullen, psig | 16.90 | 15.40 |
| Tear, gm | 98.40 | 120.80 |
| Tensile, lb/in | 13.60 | 12.00 |
| Density gm/cc | 0.497 | 0.455 |

Although the viscosity of the fibers from the supercritical delignification process is typically lower than the fibers from a kraft process, the strength of paper made from supercritical delignification process pulp is similar to that from the kraft process.

Accordingly, one skilled in the art may recognize a number of significant advantages obtainable by the use of supercritical delignification method of this invention. Digestion time may be significantly reduced, wood chip size may be increased, the reject percentage may be decreased, pulp uniformity will be increased due to mass and heat transfer and pulp yield will be higher beyond that of conventional kraft process. While the conventional kraft process utilizes a temperature of about 170° C. in the digestor, supercritical pulping can be accomplished, with the ammonia based solvent disclosed herein, at temperatures as low as about 135° C. Thus, enhanced pulp quality can be obtained due to the relatively shorter contact times in the digestor, resulting in a significant reduction in the number of post-treatment steps required to be performed on the pulp. Further, the recovery cycle in the supercritical delignification process taught herein is less capital and energy intensive, and extracted components are more easily fractionated for possible recycling.

What is claimed is:

1. Process for converting wood to pulp which comprises contacting wood with a supercritical fluid that contains a delignification agent comprising sodium hydroxide and/or sodium sulfide and/or sodium bisulfate under supercritical conditions sufficient to remove lignin, extractive and hemicellulose from the wood thereby making a full chemical pulp.

2. Process according to claim 1 wherein the supercritical fluid is a fluid selected from the group consisting of lower alkenes, lower alkanes, nitrous oxide, sulfur dioxide, ammonia, water, lower straight chain alcohols, amines, phenol, carbon dioxide, mixtures thereof, and other compounds with critical temperatures in the range of 5° C. to 250° C.

3. Process according to claim 2 wherein the supercritical conditions are a temperature from 5° C. to 250° C. and a pressure from 400 to 3500 pounds per square inch absolute.

4. Process according to claim 3 wherein the supercritical fluid is ammonia-water containing as the delignification agent sodium hydroxide and sodium sulfide.

5. Process for removing lignin from a lignin containing cellulosic material which comprises contacting the cellulose material with a supercritical fluid containing an active delignification agent comprising sodium hydroxide and/or sodium sulfide and/or sodium bisulfate under supercritical conditions whereby lignin is removed from the cellulosic material.

6. Process according to claim 5 wherein the supercritical fluid is a fluid selected from the group consisting of lower alkenes, lower alkanes, nitrous oxide, sulfur dioxide, ammonia, water, lower straight chain alcohols, amines, phenol, carbon dioxide, mixtures thereof, and other compounds with critical temperatures in the range of 5° C. to 250° C.

7. Process according to claim 6 wherein the supercritical conditions are a temperature from 5° C. to 250° C. and a pressure from 400 to 3500 pounds per square inch absolute.

8. Process according to claim 7 wherein the supercritical fluid is ammonia-water containing as the delignification agent sodium hydroxide and sodium sulfide.

9. Process for the delignification of a cellulosic material containing lignin which comprises impregnating the cellulosic material with a delignification agent comprising sodium hydroxide and/or sodium sulfide and/or sodium bisulfate and digesting the impregnated material in an ammonia based fluid comprising ammonia containing less than about 12% by weight water under supercritical conditions.

10. Process according to claim 9 wherein the delignification agent comprises an aqueous solution of sodium hydroxide and sodium sulfide.

11. Process according to claim 10 wherein supercritical conditions include a temperature from 5° C. to 250° C. and a pressure from 400 to 3500 pounds per square inch absolute.

12. Process for making paper which comprises impregnating wood with a first supercritical fluid containing a delignification agent comprising sodium hydroxide and/or sodium sulfide and/or sodium bisulfate under supercritical conditions, digesting the impregnated wood in the presence of a second supercritical fluid maintained under supercritical conditions sufficient to extract lignins, extractives and hemicellulose from the wood and to separate the wood into discrete fibers thereby producing a full chemical pulp, separating a liquor comprising the second fluid containing lignins, extractives and hemicellulose from the pulp and treating the pulp to conditions sufficient to convert the pulp to paper.

13. Process according to claim 12 wherein the first supercritical fluid comprises ammonia-water containing as the delignification agent sodium hydroxide and sodium sulfide.

14. Process according to claim 13 wherein the digesting of impregnated wood is conducted at a temperature in the range of 145° C. and 160° C. and a pressure from 1800 to 3000 pounds per square inch absolute.

* * * * *